US005881389A

United States Patent [19]

Fruge

[11] Patent Number: 5,881,389

[45] Date of Patent: Mar. 16, 1999

[54] HOOD WITH EAR OPENINGS

[76] Inventor: Paul E. Fruge, 1120 E. Cranberry Lake Rd., Harrison, Mich. 48625

[21] Appl. No.: 58,907

[22] Filed: Apr. 10, 1998

Related U.S. Application Data

[60] Provisional application No. 60/046,837, May 5, 1997.

[51] Int. Cl. [6] ..... A42B 1/06

[52] U.S. Cl. ..... 2/202; 2/171.5; 2/172; 2/184.5

[58] Field of Search ..... 2/202, 171.1, 171.4, 2/171.5, 171.6, 171.7, 184.5, 205, 209, 423, 172

[56] References Cited

U.S. PATENT DOCUMENTS

D. 388,239 12/1997 Li et al. .
3,531,952 10/1970 Chesebro, Jr. ..... 2/202
5,211,668 5/1993 Secord ..... 2/202
5,369,809 12/1994 Hall ..... 2/202
5,615,417 4/1997 Jackson .

*Primary Examiner*—Diana L. Biefeld
*Attorney, Agent, or Firm*—Reising, Ethington, Learman & McCulloch, PLLC

[57] ABSTRACT

The cold weather hood includes a left side wall, a right side wall, a rear wall, and a front wall. A face opening is provided in the front wall. A cord passes through a tubular passage around the face opening, and controls the size of the face opening. Shoulder recesses are provided in the lower portion of the hood, and leave a chest flap and a back flap between the recesses. Left and right ear openings are provided in the side walls. Ear opening covers are attached to the side walls above the ear openings. The ear opening covers can be held in contact with inside surfaces of the hood surrounding the ear openings to close the ear openings. The ear opening covers can also be held against the outside surface of the hood above the ear openings by magnets to open the openings for improved hearing.

15 Claims, 1 Drawing Sheet

HOOD WITH EAR OPENINGS

This application claims benefit of Provisional Appl. 60/046,837, filed May 5, 1997.

TECHNICAL FIELD

This invention relates to a cold weather hood for protecting a person's head and neck and more particularly to a hood with ear openings that can be opened to improve hearing and closed to protect ears from cold and wind.

BACKGROUND OF THE INVENTION

Hoods that cover a person's head to provide protection from cold, wind and precipitation are well known. Many raincoats and cold weather coats have intregal hoods that cover everything but a person's eyes, nose, and mouth. These hoods all have one major drawback. They substantially reduce a person's ability to hear.

People who spend time outdoors frequently need to hear what is going on around them. If they are working with others, looking for birds or other animals, hunting, or engaged in recreational activities, they may need to hear well. The current solution to the hearing problem created by hoods is to remove the hood. Removing a hood often takes away the protection provided by a hood when it is most needed. Some people try to loosen the hood and pull it back to expose one ear. With most hoods this procedure requires that one hand be used to hold the hood. While the hood is held to expose one ear, cold wind, rain and snow may enter the hood. Hearing with one ear and covering the other ear makes it very difficult to determine the direction from which a sound originates.

The hearing problem created by hoods is especially critical for hunters, bird watchers, and soldiers. A bow hunter, for example, may sit quietly in one place for ten hours or more waiting for an animal to appear. If he cannot hear well, the animal may walk past within a few feet and not be heard or seen, or, if they are seen, it may be too late to react. To sit outside for long period of time without the protection from the cold and wind provided by a hood may result in frostbite or other injury.

Garments such as hats and neck scarves generally do not provide the protection from the elements afforded by a hood. They also interfere with hearing. However, it may be possible to uncover the ears without completely removing a hat or scarf.

SUMMARY OF THE INVENTION

An object of the invention is to provide a hood for protecting a person from the elements when engaged in outdoor activities. Another object of the invention is to provide a hood with ear openings that can be separately opened and closed. A further object of the invention is to provide a hood with ear open and closure flaps that are held in a closed position without fasteners.

The hood covers the head and neck of a wearer. A face opening is provided in the hood. A drawcord adjusts the size of the face opening as required. An ear opening is provided adjacent to each ear. The ear openings are large enough to let sound waves in but do not let an ear protrude out through an ear opening. The entire ear remains inside the hood.

An ear opening closure is secured to the hood for opening and closing each ear opening. When the closure is open it is held in an open position on the outside of the hood. When the closure is closed it is on the inside of the hood and is held in contact with an inside surface of the hood by the wearer's ear. These ear openings are opened and closed separately.

DESCRIPTION OF THE DRAWINGS

The presently preferred embodiment of the invention is disclosed in the following description and in the following drawings, wherein.

DETAILED DESCRIPTION

Figure 3:
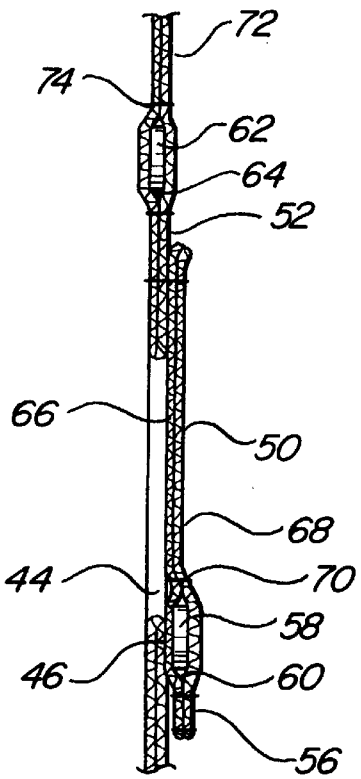
FIG. 3 is a sectional view similar to FIG. 2 with a closure in a closed position.

The hood generally designated by the reference numeral 10, includes a left sidewall 12, a right sidewall 14, a rear wall 16, and a front wall 18. These walls 12–18 are formed by cutting a sheet of fabric into the desired shape and then joining the two side edges together with a front seam 20 to form a tubular portion that surrounds the neck of a person that wears the hood.

A face opening 22 is provided in the front wall 18. Cut edges of the material around the face opening 22 are folded over to the inside and secured by stitches 24 to form a tubular passage. A cord 26 passes through the tubular passage, encircles the face opening 22 and passes out of the tubular passage at the bottom of the face opening. The cord 26 passes through a spring-loaded clamp 28 outside the tubular passage. By releasing the clamp 28, pulling cord from the tubular passage and through the clamp, and then resetting the clamp, the size of the face opening 22 is decreased. The size of the face opening is increased by releasing the clamp 28, allowing a portion of the cord 26 to pass through the clamp and into the tubular passage and then resetting the clamp.

The top portion 30 of the hood 10 is formed by stitches 32 that join the top edges of the sidewalls 12 and 14 to enclose the top of the hood. The stitches 32 preferably form a generally spherical top 30 that conforms to the shape of the top of a person's head. A separate center panel 31 in the center of the spherical top and the center of the rear wall 16 may be used to improve the hood's fit. The center panel 31 is connected to the right sidewall 14 by stitches 32 and to the left sidewall 12 by stitches 33.

Shoulder recesses 34 and 36 are provided for in the bottom portion of the left sidewall 12 and the right sidewall 14. These shoulder recesses 34 and 36 leave a chest flap 38 that extends down over the upper portion of a person's chest and a back flap 40 that extends down the upper portion of a person's back. A coat worn over the back flap 40 and chest flap 38 creates a seal that reduces the movement of cold air into the bottom of the hood 10.

A left ear opening 42 and a right ear opening 44 are provided in the left side wall 12 and the right side wall 14, respectively. These ear openings 42 and 44 have sufficient size to permit the wearer of the hood 10 to hear substantially as well as he would hear with the hood removed. However, the openings 42 and 44 are too small for a portion of a person's outer ear to extend outside the hood. The edges of the openings 42 and 44 are turned to the inside and held in place by stitches 46.

Ear opening closure flaps 50 are sewn to the inside surface 52 of each sidewall 12 and 14 above each ear opening 42 and 44. These closure flaps 50 are somewhat larger than the ear openings and are held against the inside surface 52 of the hood 10 by the wearer's ear. The ridge formed around the edge of each ear opening 42 or 44 by the stitches 46 and the turned in edges of the openings insures a seal between the closure flap 50 and the inside surface 52 of the hood 10. Gravity moves the closure flap 50 into the closed position initially when the flaps are inside the hood 10.

Figure 2:
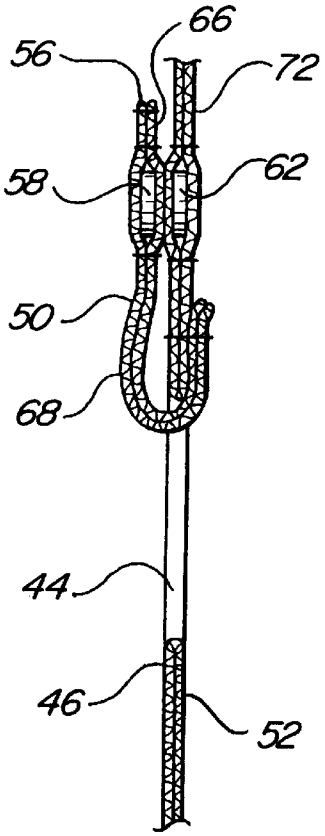
FIG. 2 is a sectional view taken along line 2—2 with the closure in an open position.
Figure 1:
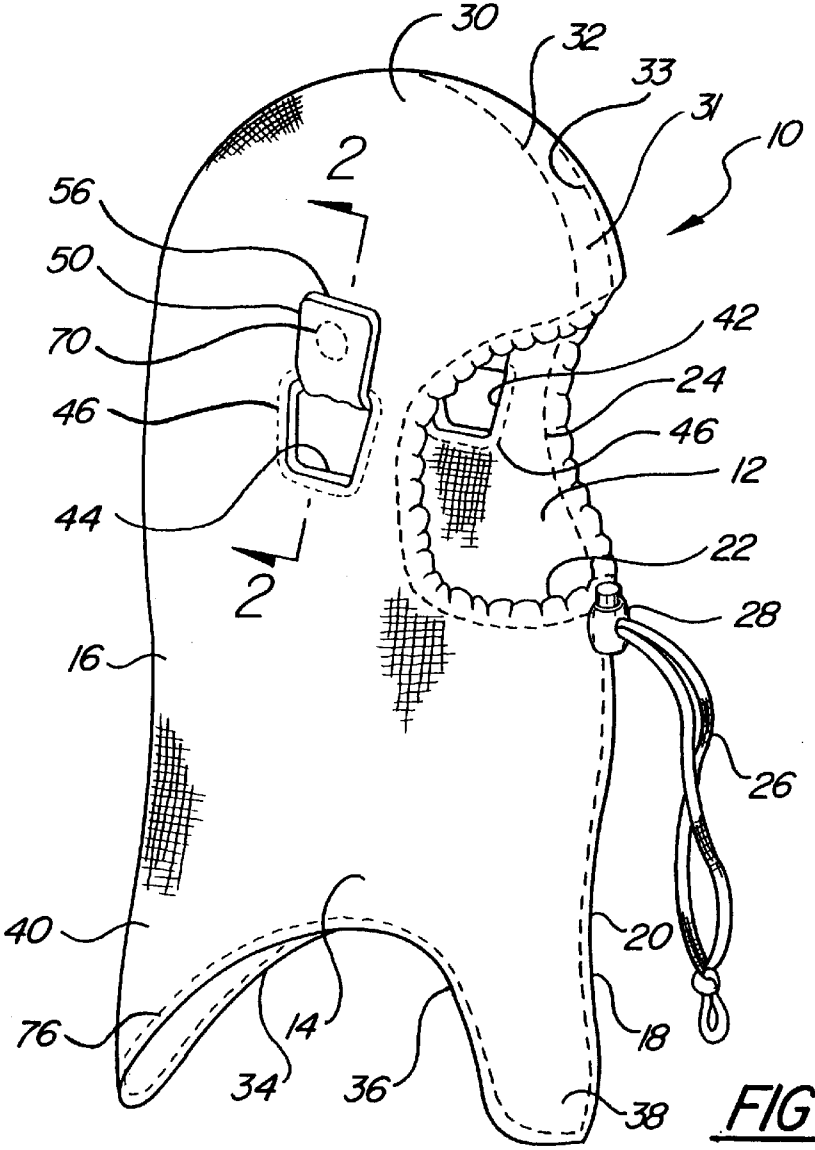
FIG. 1 is a perspective view of the hood with the closures in an open position.

To move a closure flap 50 to an open position and thereby open the ear openings 42 or 44, a person reaches through an ear opening, grasps the lower portion of the closure flap and pulls the lower closure flap portion through the ear opening. The free end 56 of the closure flap 50 is then lifted up and a small magnet 58 in a pocket 60 in the flap is attracted to a magnet 62 in a pocket 64 in a side wall 12 or 14 of the hood 10 to hold the flap in an open position. The flap 50 as shown in FIGS. 2 and 3 has an outer fabric layer 66 and an inner fabric layer 68. The pocket 60 is formed by stitches 70 that pass through the inner and outer fabric layers 66 and 68.

The hood 10 as shown in FIGS. 2 and 3 has an inner fabric lining 72. The lining 72 is sewn to hood 10 around the ear openings 42 and 44 and the face opening 22. The lower edge of the lining is secured to the edges of the walls 12, 14, 16, and 18 by surged edge stitching 76. The pockets 64 are formed by stitches 74 that secure the lining 72 to the sidewall 12 or 14.

The closure flap 50 is removed from the open position shown in FIG. 2 to the closed position shown in FIG. 3 by grasping the free end 56 of the flap 50 and separating the magnet 58 from the magnet 62. The free end 56 of the closure flap is then forced through the opening 42 or 44 and into the inside of the hood 10. With the closure flap 50 inside the hood 10 and in the closed position as shown in FIG. 3, an ear of a person wearing the hood will hold the flap in sealing contact with the inside surface 52 as described above.

The closure flaps 50 can both be in the open position when listening for animals or other sounds. When engaged in an activity that does not require the detection of soft sounds, both closure flaps 50 can be in the closed position. At other times, the closure flap 50 on one side can be closed and the closure flap on the other side can be open.

The lining 72 preferably covers the entire inside of the hood 10 if the hood is to be used in cold weather. If the hood is to be used in mild weather conditions, the lining 72 inside the hood 10 may be provided only in the areas of the pockets 64 with magnets 62.

The single face opening 22 in the hood 10 could be replaced by multiple openings. There could, for example, be a separate opening for each eye and a separate opening for the nose and mouth of the wearer.

The disclosed embodiment is representative of a presently preferred form of the invention, but is intended to be illustrative rather than definitive thereof. The invention is defined in the claims.

I claim:

1. A hood comprising a left side wall, a right side wall, a rear wall, and a front wall joined together to enclose a person's head, a lower opening which permits the hood to be slipped over a person's head as well as to be removed from a person's head, a face opening in the front wall that exposes a portion of a person's face, a left ear opening in the left side wall that allows sound to reach a person's left ear, a left ear opening closure attached to the hood above the left ear opening and wherein the left ear opening closure completely closes the left ear opening when extending downward from an upper edge of the left ear opening, a left hood magnet secured to the left side wall above the left ear opening, a left closure magnet secured to the left ear opening closure that is attracted to the left hood magnet to keep the left ear opening uncovered, a right ear opening in the right side wall that allows sound to reach a person's right ear, a right ear opening closure attached to the hood above the right ear opening and wherein the right ear opening closure completely closes the right ear opening when extending downward from an upper edge of the right ear opening, a right hood magnet secured to the right side wall above the right ear opening and a right closure magnet secured to the right ear opening closure that is attracted to the right hood magnet to keep the right ear opening uncovered.

2. A hood as set forth in claim 1 wherein the hood includes a tubular neck engaging portion that encircles a hood wearer's neck.

3. A hood as set forth in claim 2 wherein the face opening is encircled by a tubular passage, and a cord passing through the tubular passage controls the size of the face opening.

4. A hood as set forth in claim 2 wherein the tubular neck engaging portion includes a left shoulder recess, a right shoulder recess, a chest flap, and a back flap.

5. A hood as set forth in claim 1 including a hood liner that lines the inside surfaces of the hood and is held in place by a plurality of stitches.

6. A hood comprising a left side wall, a right side wall, a rear wall, and a front wall joined together to enclose a person's head, a lower opening which permits the hood to be slipped over a person's head as well as to be removed from a person's head, a face opening in the front wall that exposes a portion of a person's face, a left ear opening in the left side wall that allows sound to reach a person's left ear, a left ear opening closure attached to the hood above the left ear opening and wherein the left ear opening closure completely closes the left ear opening when extending downward from an upper edge of the left ear opening, a right ear opening in the right side wall that allows sound to reach a person's right ear, a right ear opening closure attached to the hood above the right ear opening and wherein the right ear opening closure completely closes the right ear opening when extending downward from an upper edge of the right ear opening; and wherein the left ear opening closure is in sealing contact with an inside surface of the left side wall when closing the left ear opening, and the right ear opening closure is in sealing contact with an inside surface of the right side wall when closing the right ear opening.

7. A hood as set forth in claim 1 including a left closure retainer connected to the hood and operable to hold the left ear opening closure in an open position and expose the left ear to improve hearing, and a right closure retainer connected to the hood and operable to hold the right ear opening closure in an open position, and expose the right ear to improve hearing.

8. A hood as set forth in claim 7 wherein the left closure retainer includes a left hood magnet secured to the left side wall above the left ear opening, a left closure magnet secured to the left ear opening closure that is attracted to the left hood magnet to keep the left ear opening uncovered; and the right closure retainer includes a right hood magnet secured to the right side wall above the right ear opening and a right closure magnet secured to the right ear opening closure that is attracted to the right hood magnet to keep the right ear opening uncovered.

9. A hood as set forth in claim 6 wherein the left ear opening closure is held in contact with an outside surface of the left side wall above the left ear opening when the left ear opening closure is held in an open position, and the right ear opening closure is held in contact with an outside surface of the right side wall above the right ear opening when the right ear opening closure is held in an open position.

10. A hood comprising a left side wall, a right side wall, a rear wall, and a front wall joined together to enclose a person's head, a lower opening which permits the hood to be placed on a person's head as well as to be removed from a person's head, a neck encircling skirt portion, a face opening in the front wall that exposes a portion of a person's face, a tubular passage encircling the face opening, an adjustable draw-cord passing through the tubular passage that controls the size of the face opening, a left ear opening in the left side wall, a right ear opening in the right side wall, a left ear opening closure attached to the left side wall above the left ear opening that is movable between a closed position in sealing contact with an inside surface of the left side wall surrounding the left ear opening and an open position in which the left ear opening closure is retained against an outside surface of the left side wall above the left ear opening, and a right ear opening closure attached to the right side wall above the right ear opening that is movable between a closed position in sealing contact with an inside surface of the right side wall surrounding the right ear opening and an open position in which the right ear opening closure is retained against an outside surface of the right side wall above the right ear opening.

11. A hood as set forth in claim 10 wherein the left ear opening closure and the right ear opening closure are retained in open positions by a plurality of magnets.

12. A hood as set forth in claim 11 wherein the plurality of magnets includes a left closure magnet in a left closure pocket formed in the left ear opening closure, a left side magnet in a left side wall pocket, a right closure magnet in a right closure pocket formed in the right ear opening closure, and a right side magnet in a right side wall pocket.

13. A hood as set forth in claim 10 including a hood liner that lines the inside surfaces of the hood and is held in place by a plurality of stitches.

14. A hood as set forth in claim 10 wherein the neck encircling skirt portion includes a left shoulder recess, a right shoulder recess, a chest flap and a back flap.

15. A method of improving hearing when wearing cold weather hood with a face opening, a left ear opening, a left ear opening cover, a right ear opening, and a right ear opening cover comprising:

pulling a portion of the left ear opening cover out through the left ear opening and from a position between an inside surface of the hood and a left side of an ear;

moving a free end of the left ear opening cover to one side of the left ear opening and thereby opening the left ear opening;

restraining the free end of the left ear opening cover to keep the left ear opening open;

pulling a portion of the right ear opening cover out through the right ear opening and from a position between the inside surface of the hood and a right side of a right ear;

moving a free end of the right ear opening cover to one side of the right ear opening and thereby opening the right ear opening; and restraining the free end of the right ear opening cover to keep the right ear opening open.

* * * * *